US008448461B2

(12) United States Patent
Longsworth

(10) Patent No.: US 8,448,461 B2
(45) Date of Patent: May 28, 2013

(54) FAST COOL DOWN CRYOGENIC REFRIGERATOR

(75) Inventor: Ralph Longsworth, Allentown, PA (US)

(73) Assignee: Sumitomo (SHI) Cryogenics of America Inc., Allentown, PA (US)

( * ) Notice: Subject to any disclaimer, the term of this patent is extended or adjusted under 35 U.S.C. 154(b) by 0 days.

(21) Appl. No.: 13/252,244

(22) Filed: Oct. 4, 2011

(65) Prior Publication Data

US 2012/0085121 A1 Apr. 12, 2012

(51) Int. Cl.
*F25D 9/00* (2006.01)

(52) U.S. Cl.
USPC ..... 62/401; 62/403

(58) Field of Classification Search
USPC ..... 62/401, 402, 403, 47.1, 51.1, 48.2, 62/6
See application file for complete search history.

(56) References Cited

U.S. PATENT DOCUMENTS

| | | | | |
|---|---|---|---|---|
| 2,607,322 | A | 8/1952 | Collins | |
| 3,045,436 | A | 7/1962 | Gifford et al. | |
| 3,620,029 | A | 11/1971 | Longsworth | |
| 3,902,328 | A * | 9/1975 | Claudet | 62/6 |
| 4,291,547 | A * | 9/1981 | Leo | 62/402 |
| 4,543,794 | A | 10/1985 | Matsutani et al. | |
| 4,951,471 | A | 8/1990 | Sakitani et al. | |
| RE33,878 | E * | 4/1992 | Bartlett et al. | 62/47.1 |
| 5,386,708 | A | 2/1995 | Kishorenath et al. | |
| 5,582,017 | A | 12/1996 | Noji et al. | |
| 6,374,617 | B1 | 4/2002 | Bonaquist et al. | |
| 6,523,347 | B1 * | 2/2003 | Jirnov et al. | 60/651 |
| 6,530,237 | B2 | 3/2003 | Morse et al. | |
| 7,127,901 | B2 | 10/2006 | Dresens et al. | |
| 2005/0034465 | A1 * | 2/2005 | Borchers et al. | 62/55.5 |
| 2005/0274334 | A1 * | 12/2005 | Warren | 123/68 |
| 2007/0119189 | A1 * | 5/2007 | Gao | 62/6 |
| 2008/0011550 | A1 * | 1/2008 | Dunn et al. | 184/6.23 |
| 2011/0219810 | A1 | 9/2011 | Longsworth | |

FOREIGN PATENT DOCUMENTS

| | | | |
|---|---|---|---|
| JP | 05079717 | A | 3/1993 |
| JP | 2001355929 | A | 12/2001 |
| JP | 2008249201 | A | 10/2008 |
| WO | 2008/094357 | | 8/2008 |

OTHER PUBLICATIONS

File History of U.S. Appl. No. 13/039,763.
International Search Report dated Feb. 17, 2012 from the corresponding PCT/US2011/054694.

* cited by examiner

*Primary Examiner* — Mohammad Ali
(74) *Attorney, Agent, or Firm* — Katten Muchin Rosenman LLP

(57) ABSTRACT

A refrigeration system for minimizing the cool down time of a mass to cryogenic temperatures including a compressor, an expander, a gas storage tank, interconnecting gas lines, and a control system. The compressor output is maintained near its maximum capability by maintaining near constant high and low pressures during cool down, gas being added or removed from the storage tank to maintain a near constant high pressure, and the speed of said expander being adjusted to maintain a near constant low pressure, no gas by-passing between high and low pressures.

21 Claims, 3 Drawing Sheets

FAST COOL DOWN CRYOGENIC REFRIGERATOR

BACKGROUND OF THE INVENTION

1. Field of the Invention

This invention relates to a means to minimize the time to cool down a mass to cryogenic temperature using a refrigerator that operates on a Brayton or GM cycle.

2. Background Information

Most cryogenic refrigerators are designed to provide refrigeration at a low temperature over a long period, and system simplicity is given priority over efficiency during cool down. Most expanders and compressors are designed to operate at constant speed and most systems have a fixed charge of gas, usually helium. The mass flow rate through the expander is proportional to the density of the gas, thus when the expander is running warm it has a much lower flow rate than when it is cold. The compressor is sized to provide the flow rate that is needed when the unit is cold and the system is usually designed with an internal pressure relief valve that by-passes the excess flow of gas when it is warm. As the refrigerator cools down the gas in the cold end becomes denser so the high and low pressure of the gas in the system drops. The pressure difference drops and as the refrigerator approaches its designed operating temperature all of the compressor flow goes through the expander and none is by-passed. As the gas pressures drop during cool down the input power also drops. In effect the heaviest load on the compressor occurs at start up when only part of the output flow is utilized.

The problem of cooling a mass down to cryogenic temperatures is different than the problem of removing heat from a mass that is cold and is subject to heat loads from conduction, radiation, and internal heat generation. Most refrigerators have been designed to keep a load cold, frequently with heat loads that vary. U.S. Pat. No. 5,386,708 is an example of a cryopump that is maintained at a constant temperature by controlling the speed of the expander. U.S. Pat. No. 7,127,901 describes a system with one compressor supplying gas to multiple cryopumps. Speed of the individual expanders is controlled to balance the heat loads on the different cryopumps. U.S. Pat. No. 4,543,794 describes controlling the pressure (temperature in two phase region) in a superconducting magnet by controlling the compressor speed. Expander and compressor speeds have also been controlled to minimize power input.

Adding gas to a system to compensate for the increase in gas density has been described in U.S. Pat. No. 4,951,471. The use of adding and removing gas in a system using a gas storage tank for the purpose of conserving power has been described in U.S. Pat. No. 6,530,237.

In general the systems described herein have input powers in the range of 5 to 15 kW but larger and smaller systems can fall within the scope of this invention. A system that operates on the Brayton cycle to produce refrigeration consists of a compressor that supplies gas at a high pressure to a counterflow heat exchanger, an expander that expands the gas adiabatically to a low pressure, exhausts the expanded gas (which is colder), circulates the cold gas through a load being cooled, then returns the gas through the counterflow heat exchanger to the compressor. A reciprocating expander has inlet and outlet valves to admit cold gas into the expansion space and vent colder gas to the load. U.S. Pat. No. 2,607,322 by S. C. Collins has a description of the design of an early reciprocating expansion engine that has been widely used to liquefy helium. The expansion piston in this early design is driven in a reciprocating motion by a crank mechanism connected to a fly wheel and generator/motor which can operate at variable speed. Compressor input power is typically in the range of 15 to 50 kW for the systems that have been built to date. Higher power refrigerators typically operate on the Brayton or Claude cycles using turbo-expanders.

Refrigerators drawing less than 15 kW typically operate on the GM, pulse tube, or Stirling cycles. U.S. Pat. No. 3,045,436, by W. E. Gifford and H. O. McMahon describes the GM cycle. These refrigerators use regenerator heat exchanges in which the gas flows back and forth through a packed bed, cold gas never leaving the cold end of the expander. This is in contrast to the Brayton cycle refrigerators that can distribute cold gas to a remote load. GM expanders have been built with mechanical drives, typically a Scotch Yoke mechanism, and also with pneumatic drives, such as described in U.S. Pat. No. 3,620,029. U.S. Pat. No. 5,582,017 describes controlling the speed of a GM expander having a Scotch Yoke drive as a means to minimize regeneration time of a cryopump. The speed at which the displacer moves up and down in a '029 type pneumatically driven GM cycle expander is set by an orifice which is typically fixed. This limits the range over which the speed can be varied without incurring significant losses. Applicants' application PCTUS0787409, describes a speed controller for a '029 type pneumatically driven expander with a fixed orifice that operates over a speed range of about 0.5 to 1.5 Hz but the efficiency falls off from the best orifice setting. The speed range of this expander can be increased without sacrificing efficiency by making the orifice adjustable.

The applicant for this patent recently filed an application Ser. No. 61/313,868 for a pressure balanced Brayton cycle engine that will compete with GM coolers in the 5 to 15 kW power input range. Both mechanical and pneumatic drives are included. The pneumatic drive includes an orifice to control the piston speed. This orifice can be variable so the setting can be optimized as the speed is changed.

Applications for this refrigerator system might include cooling a superconducting magnet down to about 40 K then using another means to cool it further and/or keep it cold, or cooling down a cryopanel to about 125 K and operating the refrigerator to pump water vapor. Helium would be the typical refrigerant but another gas such as Ar could be used in some applications.

SUMMARY OF THE INVENTION

The present invention uses the full output power of the compressor during cool down to a cryogenic temperature to maximize the refrigeration rate by a) operating an expander at maximum speed near room temperature then slowing it down as the load is cooled, and b) transferring gas from a storage tank to the system in order to maintain a constant supply pressure at the compressor. An expansion engine or a GM expander, for example, is designed to operate at a speed of about 9 Hz at 300 K dropping to almost 1 Hz at 40 K and to operate at speeds that maintain a near constant pressure difference between the supply and return gas pressures at the compressor. The expanders can have a mechanical drive with a variable speed motor or a pneumatic drive with a variable speed motor tuning a rotary valve and having an adjustable orifice to optimize the piston or displacer speed as the expander speed changes.

DESCRIPTIONS OF THE PREFERRED EMBODIMENTS

Figure 1:
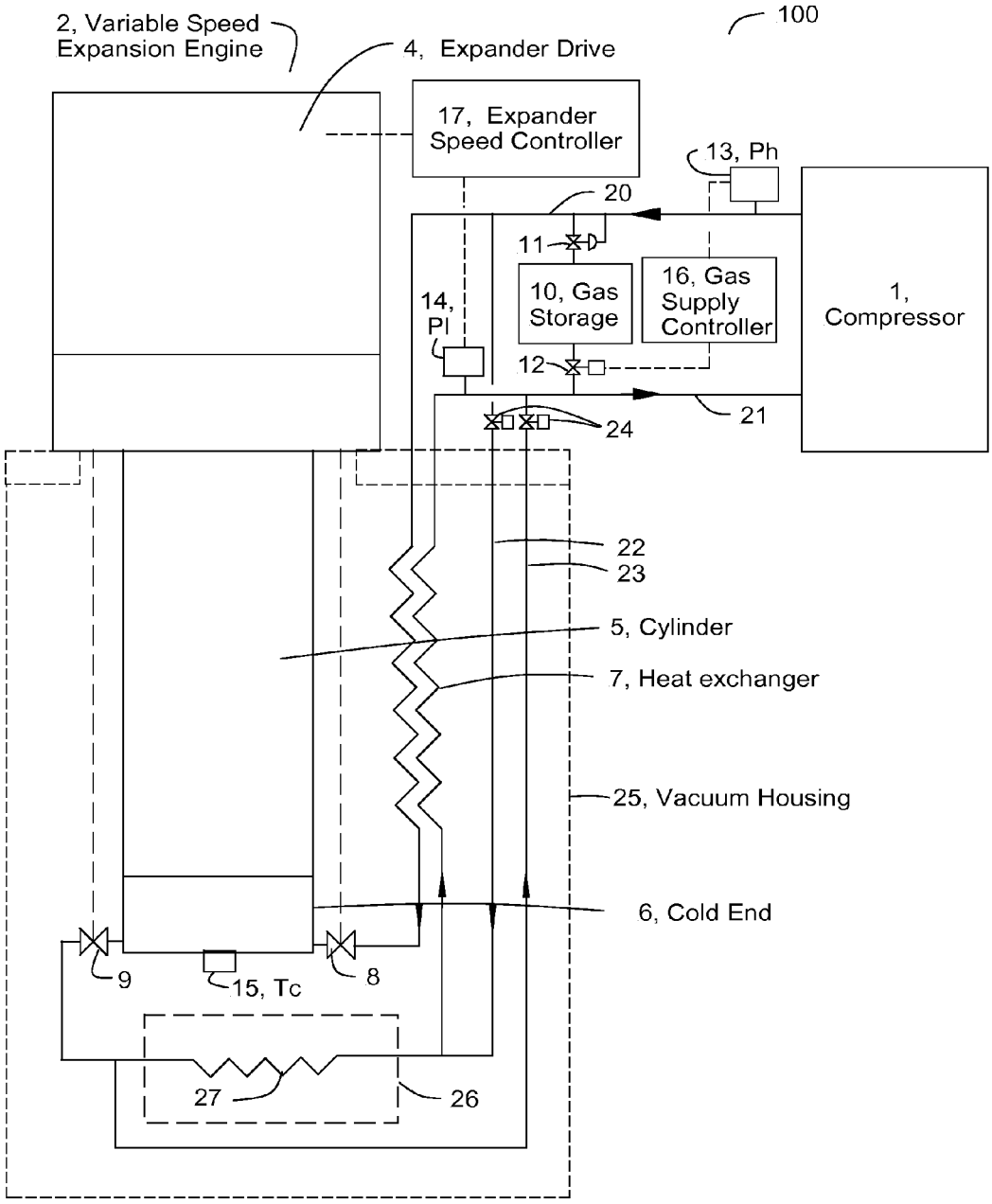
FIG. 1 is a schematic view of fast cool down refrigerator assembly 100 which incorporates a Brayton cycle engine.
Figure 2:
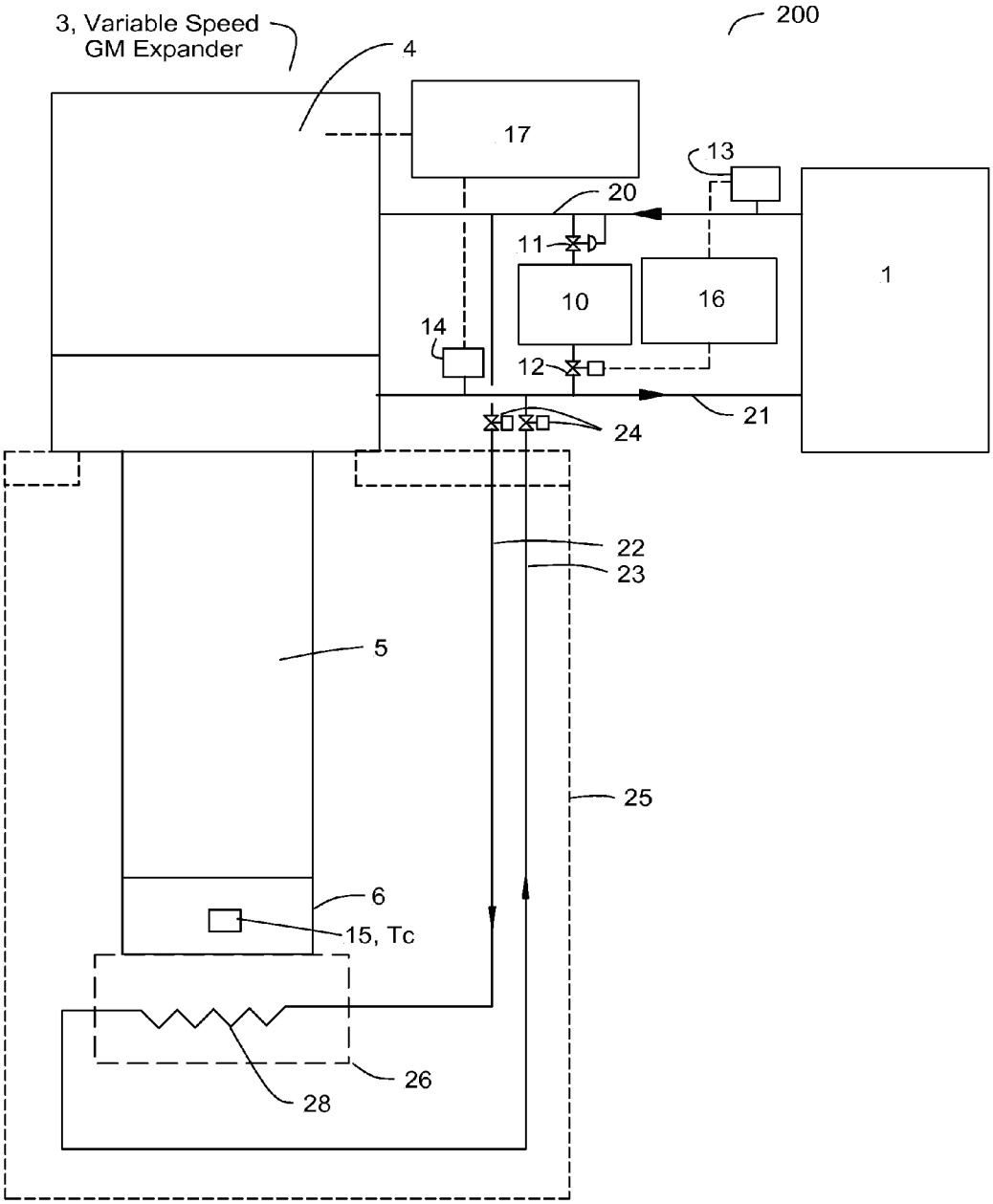
FIG. 2 is a schematic view of fast cool down assembly 200 which incorporates a GM cycle expander.
Figure 3:
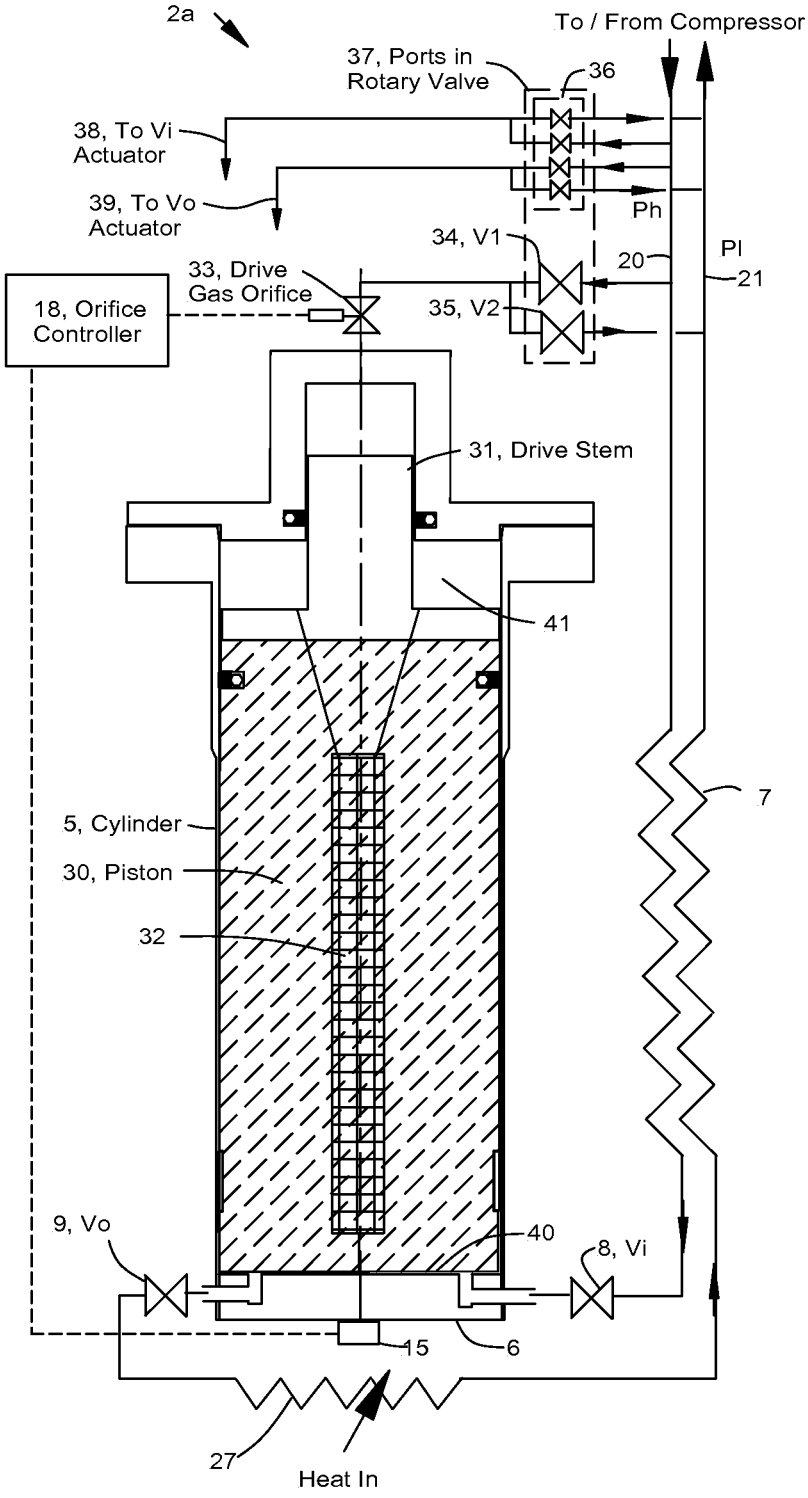
FIG. 3 is a schematic view of a preferred embodiment of the Brayton cycle engine shown in FIG. 1.

The embodiments of this invention that are shown in FIGS. 1, 2 and 3 use the same number and the same diagrammatic representation to identify equivalent parts.

For a system that operates on a Carnot cycle, no losses, the ideal refrigeration rate, Q, is equal to the power input, Pwr, by the relation $$Q=\text{Pwr}*(Tc/(Ta-Tc))$$

where Ta is ambient temperature and Tc is the cold temperature at which the refrigeration is available. For a Brayton cycle system in which the gas is compressed and expanded adiabatically the relation is $$Q=\text{Pwr}*(Tc/Ta)$$

From this it is seen that Q is maximized by operating the compressor at it the maximum power input that it is designed to handle. This is done by maintaining the high and low pressures, Ph and Pl, at constant values that maximize the input power. The mass flow rate from the compressor is constant. Most of this gas flows in and out of the expansion space, which is usually a fixed volume, thus as the expander cools down and the gas becomes denser the speed of the expander needs to be reduced approximately proportional to Tc. In the case of a pneumatically driven GM or Brayton expander perhaps 5% of the gas is diverted to drive the piston and in the case of a GM expander approximately 30% of the gas only flows in and out of the regenerator. In a real machine other losses include those due to pressure drop, heat transfer temperature differences, incomplete expansion of the gas, electrical resistance, etc.

The main components in fast cool down refrigerator assembly 100, shown schematically in FIG. 1, include compressor 1, variable speed expansion engine 2, gas storage tank 10, gas supply controller 16, and expander speed controller 17. Pressure transducer 13 measures the high pressure, Ph, near the compressor and pressure transducer 14 measures the low pressure, Pl, near the compressor. Gas flows into storage tank 10 through back-pressure regulator 11 when the pressure in the high pressure gas line 20 exceeds the desired value of Ph such as when the system is warmed up. Gas flows out of storage tank 10 and into low pressure line 21 when gas supply solenoid valve 12 is opened by gas supply controller 16 in response to a drop in pressure Ph below the desired value. Low pressure Pl in line 21 is controlled by expander speed controller 17 which senses Pl from pressure transducer 14 and increases the speed of engine 2 if Pl is below a desired value or decreases the speed if Pl is above the desired value.

Expansion engine 2 includes expander drive 4, cylinder 5 that has a reciprocating piston inside, cold end 6, counterflow heat exchanger 7, inlet valve 8, and outlet valve 9. Cold end 6 has temperature sensor 15 mounted on it to measure Tc. Cold gas exiting through valve 9 flows through heat exchanger 27 where it cools mass 26. All of the cold components are shown contained in vacuum housing 25. By-pass gas lines 22 and 23 may be included for fast warm up of mass 26 by stopping engine 2 and opening solenoid valves 24. Such a by-pass circuit might be used to warm up a cryopanel.

Fast cool down refrigerator assembly 200, shown schematically in FIG. 2 differs from assembly 100 in replacing variable speed Brayton cycle engine 2 with variable speed GM cycle expander 3. Internal to cylinder 5 is a displacer with a regenerator, the regenerator serving the same function as heat exchanger 7 in engine 2. GM expander 3 produces refrigeration within cold end 6 so the mass being cooled, 26, has to be attached directly to cold end 6. The option of a by-pass circuit for fast warm up of mass 26 is shown as consisting of solenoid valves 24, gas lines 22 and 23, and heat exchanger 28. The remaining components shown in FIG. 2 are the same as those in FIG. 1.

FIG. 3 is a schematic view of a preferred embodiment of a Brayton cycle engine, 2*a*, shown in FIG. 1 as variable speed expansion engine 2. The operation of engine 2*a* is described more fully in our application Ser. No. 61/313,868, for a pressure balanced Brayton cycle engine which includes options for pneumatically and mechanically driven pistons. A mechanically driven piston is easier to adapt to variable speed operation but a pneumatically driven piston can be adapted if the orifice that controls the piston speed, 33, can be controlled. Orifice controller 18, which uses temperature sensor 15 as a basis for control, adjusts the orifice opening as the engine cools down to maximize the cooling that is produced for the pressures and flow rate that are maintained at near constant values. This pneumatically driven engine is mechanically simpler than a mechanically driven engine and is preferred for this reason.

Pressure in displaced volume 40 at the cold end of piston 30 is nearly equal to the pressure in displaced volume 41 at the warm end of piston 30 by virtue of connecting gas passages through regenerator 32. Inlet valve Vi, 8, and outlet valve Vo, 9, are pneumatically actuated by gas pressure cycling between Ph and Pl in gas lines 38 and 39. The actuators are not shown. Rotary valve 37, shown schematically, has four ports, 36, for the valve actuators and two ports, 34 and 35 that switch the gas pressure to drive stem 31 that causes piston 30 to reciprocate.

An example of system 100 designed with expansion engine 2*a* includes a scroll compressor, 1, having a displacement of 5.6 L/s and a mass flow rate of helium of 6 g/s at Ph of 2.2 MPa and Pl of 0.7 MPa, and power input of 8.5 kW. Engine 2*a* has a displaced volume, 40, of 0.19 L.

Ambient temperature is taken as 300 K. Real losses include pressure drop in the compressor, gas lines, heat exchanger and valves, heat transfer losses, electrical losses, losses associated with oil circulation in the compressor, and gas used for the pneumatic actuation. Taking these losses into account the engine performance is calculated to be as listed in Table 1. Efficiency is calculated relative to Carnot

TABLE 1

Calculated system performance.

| Temperature, Tc - K | Engine Speed - Hz | Refrigeration, Q - W | Efficiency - % |
|---|---|---|---|
| 300 | 9.0 | 1,800 | — |
| 250 | 7.6 | 1,560 | 3.7 |
| 200 | 6.2 | 1,240 | 7.3 |
| 150 | 4.7 | 910 | 10.7 |
| 100 | 3.2 | 560 | 13.3 |
| 80 | 2.6 | 420 | 13.6 |
| 60 | 1.9 | 270 | 12.7 |
| 40 | 1.3 | 120 | 9.2 |

The peak efficiency is near 80 K and the losses, mostly in the heat exchanger, prevent the system from getting below about 30 K. The speed changes by a ratio of about 7:1. An expander that is optimized to operate efficiently at lower temperatures would have a smaller displacement and a larger heat exchanger. It would also have to operate over a wider range of speeds to have high capacity near room temperature. If the expander in the above example had a maximum speed of 9.0 Hz and a minimum speed of 2.6 Hz, a speed range of 3.5:1, it will use maximum compressor power down to about 80 K. Below this temperature the low pressure will increase, the high pressure will decrease, and the input power and refrigeration will be reduced. At 40 K it is calculated that the refrigeration rate would be reduced by about 40% and the input power by about 25%. If the expander in the above example had a maximum speed of 7.6 Hz and a minimum speed of 1.9 Hz, a speed range of 4:1, gas will by-pass in the compressor while it cools to 250 K then use all of the gas at maximum compressor power down to about 60 K. Above 250 K the refrigeration rate will be only slightly more than rate at 250 K but the input power will remain at 8.5 kW. If the minimum speed in this last example is 3.2 Hz, a speed range of about 2.4:1, then it will use all of the gas at maximum compressor power from 250 K down to about 100 K.

Systems 100 and 200 are both shown in FIGS. 1 and 2 with optional gas by-pass lines 22 and 23 that can be used for fast warm up of mass 26 by stopping engine 2, or expander 3, and opening valves 24. Flow rate and pressures are set by the size of the orifices in valves 24 or separate valves that are not shown. Low pressure in line 21 can be higher than during cool down in order to increase the mass flow rate of the refrigerant and reduce the input power. As the system warms up, gas flows back into gas storage tank 10 through back pressure regulator 11.

The following claims are not limited to the specific components that are cited. For example back-pressure regulator 11 and solenoid valve 12 can be replaced with actively controlled valves that serve the same functions. It is also within the scope of these claims to include operating limits that are less than optimum to simplify the mechanical design.

What is claimed is:

1. A refrigeration system for minimizing a time of a cool down of a mass to cryogenic temperatures, the refrigeration system comprising:

a gas storage tank for holding a volume of gas;

a compressor;

a variable speed expansion engine;

a plurality of gas lines, the plurality of gas lines operatively interconnecting the compressor, gas storage tank, and expansion engine; and a control system, wherein an output of the compressor is maintained about its maximum capability by maintaining a near-constant high pressure and a near-constant low pressure during the cool down, the gas being added or removed from said storage tank to maintain the near-constant high pressure, and the speed of the expansion engine being adjusted to maintain the near-constant low pressure, no gas by-passing between the near-constant high pressure and the near-constant low pressure.

2. The refrigeration system of claim 1, wherein the expansion engine corn rises a Brayton cycle type engine.

3. The refrigeration system of claim 1, wherein the expansion engine comprises a GM type expansion engine.

4. The refrigeration system of claim 1, further comprising a back-pressure regulator, the back pressure regulator connected to a first line of the plurality of gas lines and adding the as to the gas storage tank, the first line transmitting the gas at the near-constant high pressure.

5. The refrigeration system of claim 1, further comprising a solenoid valve, the solenoid valve connected to a first line of the plurality of gas lines and removing the gas from the gas storage tank, the first line transmitting the gas at the near-constant low pressure.

6. The refrigeration system of claim 2, further comprising a pneumatically driven piston.

7. The refrigeration system of claim 6, wherein a speed of said piston is controlled by a variable orifice.

8. The refrigeration system of claim 1, further comprising a first transducer disposed operatively with a first line of the plurality of gas lines and a second transducer disposed operatively with a second line of the plurality of gas lines, the first line transmitting the gas at the near-constant high pressure, the second line transmitting the gas at the near-constant low pressure.

9. The refrigeration system of claim 1, wherein the expansion engine comprises a maximum thermodynamic efficiency at a temperature between 70 K and 100 K.

10. The refrigeration system of claim 1, wherein the expansion engine comprises an operating speed range of more than 6:1.

11. The refrigeration system of claim 1, wherein the expansion engine comprises an operating speed range of more than 3.5:1.

12. The refrigeration system of claim 1, wherein the compressor consists of a single compressor.

13. A refrigeration system for minimizing a time for a cool down of a mass to cryogenic temperatures, the refrigeration system comprising:

a gas storage tank for holding a volume of gas;

a compressor;

a variable speed expansion engine;

a plurality of gas lines, the plurality of gas lines operatively interconnecting the compressor, gas storage tank, and expansion engine; and a control system, wherein an output of the compressor is maintained about its maximum capability by maintaining a near-constant high pressure and a near-constant low pressure during the cool down to a cryogenic temperature, the gas being added or removed from said storage tank to maintain the near-constant high pressure, and a speed of said expansion engine being adjusted to maintain the near-constant low pressure.

14. The refrigeration system of claim 13, wherein the compressor consists of a single compressor.

15. The refrigeration system of claim 13, wherein as by-passes from the near-constant high pressure to the near-constant low pressure below 250 K.

16. The refrigeration system of claim 13, wherein the cryogenic temperature is less than 100 K.

17. The refrigeration system of claim 13, wherein the expansion engine has an operating speed range of more than 2.4:1.

18. A refrigeration system for minimizing a time for a cool down of a mass to cryogenic temperatures, the refrigeration system comprising:

a gas storage tank for holding a volume of gas;

a compressor;

a variable speed expansion engine;

a gas storage tank;

a plurality of gas lines, the plurality of gas lines operatively interconnecting the compressor, gas storage tank, and expansion engine; and a control system, wherein an output of the compressor is maintained about its maximum capability by maintaining a near-constant high pressure and a near-constant low pressure during the cool down to less than 100 K, the gas being added or removed from said storage tank to maintain the near-constant high pressure, and a speed of said expander being adjusted to maintain the near-constant low pressure, no gas by-passing between the near-constant high pressure and the near-constant low pressure at temperatures below about 250 K.

19. The refrigeration system of claim 18, wherein the expansion engine has an operating speed range of more than 2.4:1.

20. The refrigeration system of claim 18, wherein the compressor consists of a single compressor.

21. A refrigeration system for minimizing a cool down time of a mass to cryogenic temperatures, the refrigeration system comprising:

a gas storage tank for holding a volume of gas;

a single compressor;

a variable speed expansion engine;

a first gas line connecting the compressor to the expansion engine, the first gas line providing a first portion of the gas at a high pressure;

a first pressure sensor operative to measure the high pressure in the first gas line;

a second gas line connecting the expansion engine to the compressor, the second gas line providing a second portion of the gas at a low pressure;

a second pressure sensor operative to measure the low pressure in the second gas line; and a controller for controlling a speed of the expansion engine responsive to the second pressure sensor and the second pressure sensor maintaining the low pressure and the high pressure at a constant level without by-passing gas between the high pressure and the low pressure.

* * * * *

UNITED STATES PATENT AND TRADEMARK OFFICE

CERTIFICATE OF CORRECTION

PATENT NO. : 8,448,461 B2
APPLICATION NO. : 13/252244
DATED : May 28, 2013
INVENTOR(S) : Ralph Longsworth It is certified that error appears in the above-identified patent and that said Letters Patent is hereby corrected as shown below:

In the Claims

Column 5, line 58 claim 2: "engine corn rises a" should be changed to --engine comprises a--; line 64 claim 4, "as to the gas storage" should be changed to --gas to the gas storage--.

Column 6, line 45 claim 15: "wherein as" should be changed to --wherein gas--; lines 58 and 59 claim 18, "a variable speed expansion engine; a gas storage tank;." should be changed to --a variable speed expansion engine;--.

Signed and Sealed this
Twenty-ninth Day of July, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,448,461 B2
APPLICATION NO. : 13/252244
DATED : May 28, 2013
INVENTOR(S) : Ralph Longsworth It is certified that error appears in the above-identified patent and that said Letters Patent is hereby corrected as shown below:

In the Claims

Column 5, line 58 claim 2: "engine corn rises a" should be changed to --engine comprises a--; line 64 claim 4, "as to the gas storage" should be changed to --gas to the gas storage--.

Column 6, line 45 claim 15: "wherein as" should be changed to --wherein no gas--; lines 58 and 59 claim 18, "a variable speed expansion engine; a gas storage tank;." should be changed to --a variable speed expansion engine;--.

This certificate supersedes the Certificate of Correction issued July 29, 2014.

Signed and Sealed this
Seventeenth Day of March, 2015

Michelle K. Lee

Michelle K. Lee
*Director of the United States Patent and Trademark Office*